United States Patent [19]

Smith

[11] Patent Number: 4,641,767

[45] Date of Patent: Feb. 10, 1987

[54] CASTING TIP ASSEMBLY WITH REPLACEABLE UPSTREAM AND DOWNSTREAM UNITS

[75] Inventor: Dennis M. Smith, Crestline, Calif.

[73] Assignee: Hunter Engineering Co., Inc., Riverside, Calif.

[21] Appl. No.: 695,679

[22] Filed: Jan. 28, 1985

[51] Int. Cl.[4] ..... B22D 11/06

[52] U.S. Cl. ..... 222/591; 222/566; 164/428; 164/437

[58] Field of Search ..... 222/591, 600, 566, 594, 222/597; 164/428, 437; 266/236

[56] References Cited

U.S. PATENT DOCUMENTS

| | | | |
|---|---|---|---|
| 2,790,216 | 4/1957 | Hunter | 222/591 X |
| 3,430,683 | 3/1969 | Hood, Jr. | 164/428 |
| 3,799,410 | 3/1974 | Blossey et al. | 164/428 X |
| 4,054,173 | 10/1977 | Hickam | 164/428 |
| 4,153,101 | 5/1979 | Chateau et al. | 164/437 X |
| 4,303,181 | 12/1981 | Lewis et al. | 164/437 X |

FOREIGN PATENT DOCUMENTS

| | | | |
|---|---|---|---|
| 619491 | 5/1961 | Canada | 164/428 |

*Primary Examiner*—H. Grant Skaggs
*Assistant Examiner*—Edward S. Ammeen
*Attorney, Agent, or Firm*—Christie, Parker & Hale

[57] ABSTRACT

A molten metal feed tip assembly comprises independently replaceable upstream and downstream units. The upstream unit comprises a pair of upstream plates spaced apart by one or more spacers. The downstream unit is preassembled and comprises a pair of spaced-apart downstream plates, each comprising two or more segments. The downstream unit also comprises spacers for maintaining the spacing between the plates and a brace, which extends across the upstream edges of the downstream plate segments to maintain the segments in edge-to-edge abutment.

4 Claims, 4 Drawing Figures

CASTING TIP ASSEMBLY WITH REPLACEABLE UPSTREAM AND DOWNSTREAM UNITS

FIELD OF THE INVENTION

This invention relates to molten metal feed tips for continuous casting machines and more particularly to a molten metal feed tip having an upstream unit and an independently replaceable downstream unit.

BACKGROUND OF THE INVENTION

For a number of years continuous casting of metals such as aluminum, lead, zinc, and the like has been conducted in commercial scale operations with continuous casters such as shown in U.S. Pat. Nos. 2,790,216 or 4,054,173, both of which are incorporated herein by this reference. Such a continuous caster comprises a pair of rotating water-cooled rolls. Molten metal, for example aluminum, is fed into the nip of the rolls just prior to the line of closest approach of the two rolls. Heat is rapidly extracted from the molten metal by contact with the rolls, and freezing occurs before the metal reaches the line of closest approach to the rolls.

With such a caster, metal sheets a couple of meters wide and about one centimeter thick can be continuously cast at rates of more than a meter per minute for several days at a time. One important aspect of such a continuous caster is the tip which is used to feed molten metal into the nip of the rolls.

Molten metal feed tips comprise a pair of spaced-apart plates between which the molten metal flows. At the downstream end of the tip, the outer surface of the plates converge, reducing the thickness of the tip at its downstream end, enabling the tip to fit closely into the nip of the rolls.

The plates of the tips are made out of multiple segments, rather than a single integral piece of material. This is done for several reasons. First, the use of multiple segments enables the width of the tip to be varied by simply varying the number of segments in each plate. This enables a single small mold to be used to make tips of various sizes rather than requiring a separate large mold for each desired tip size. Since molds are very expensive to build, this makes multiple segment plates much more economical than plates made of a single integral piece of material. In addition, wide, non-segmented or single piece plates tend to warp, particularly at their downstream edges, and hence, cannot be used.

The molten metal feed tips are made of heat resistant insulating materials which are non-wettable by the molten metal. Exemplary of such materials is an asbestos fiber-containing composition sold by Johns Manville Co. under their trademark Marinite and refractory fiber-containing compositions sold by the Carborundum Co. of Niagara Falls, N.Y., under their trademarks Fiberfrax and Kaowool.

These materials are not very strong. As a result, the tips tend to break or chip, particularly at their thin downstream edges and must be replaced. Once a broken tip has been removed from the tip holder of the casting machine, the various pieces of the new tip are assembled onto the holder. Once the pieces have been fully assembled, the outside faces of the various segments of the plates must then be sanded at their downstream ends to form a smooth flat surface which will fit uniformly into the nip of the rolls. The assembly of the tip and the sanding take a great deal of time during which the caster cannot be used. Accordingly, tip replacement tends to be a very costly procedure.

SUMMARY OF THE INVENTION

In accordance with the present invention, there is provided a molten metal feed tip assembly comprising an upstream unit and a preassembled downstream unit which can be replaced independently of the upstream unit.

The upstream unit comprises a pair of upstream plates spaced apart by one or more spacers and a pair of upstream end dams for enclosing the ends of the upstream plates. One or more channels are provided between the plates through which molten metal can flow. Likewise, the downstream unit comprises a pair of downstream plates spaced apart by one or more spacers and having one or more channels between the downstream plates for the flow of molten metal between the plates. Downstream end dams enclose the ends of the downstream plates.

The tip assembly is mountable in a tip holder with the downstream edges of the upstream unit abutting and forming a leak-proof seal with the upstream edges of the downstream unit. The channels formed between the upstream plates in the upstream unit communicate with the channels formed between the downstream plates of the downstream unit to provide a pathway for molten metal to flow through the tip.

The downstream unit is preassembled which allows the downstream edges of the downstream plates to be sanded to form a uniformly smooth, flat surface for fitting into the nip of the rolls of the casting machine. Breakage of the tip at its downstream edge requires replacement only of the preassembled downstream unit. Replacement material and machine downtime are thus minimized.

In a preferred embodiment of the invention, the downstream unit comprises downstream plates having two or more segments in edge-to-edge abutment and means for maintaining the segments in edge-to-edge abutment. Preferred means comprises a brace which extends across the width of the downstream plates and is fixedly attached to the upstream edges of the segments of the downstream plates. Openings are provided in the brace at locations corresponding to the channels between the downstream plates.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
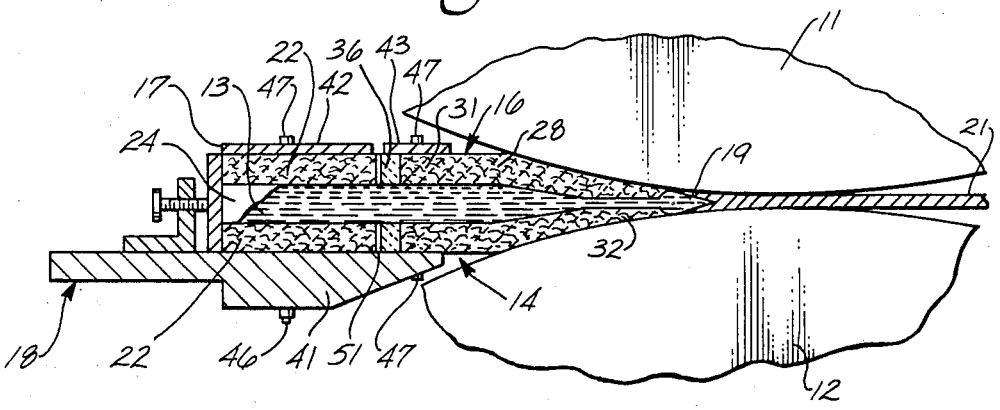
FIG. 1 is a cross-sectional view of a molten metal feed tip mounted in a tip holder.

With reference to FIG. 1, there is shown a pair of rolls 11 and 12 of a continuous casting machine. The axes of the two rolls are parallel and they are driven in the direction of movement of metal through the continuous caster (to the right in FIG. 1). Molten metal 13 is introduced into the nip of the rolls through a molten metal feed tip assembly 14 having a downstream unit 16 and an upstream unit 17 mounted in a tip holder 18. The molten metal 13 is introduced through the upstream unit 17 and flows toward the downstream unit 16. The molten metal 13 emerges from the downstream unit 16 of the feed tip assembly 14 and increases in cross-section to engage the surface of the rolls 11 and 12. Heat from the molten metal 13 is extracted by the water-cooled rolls and freezing occurs in a narrow zone 19 between the rolls and outside the molten metal feed tip assembly 14. The metal sheet so formed continues through the gap between the slowly rotating rolls and is reduced in thickness to introduce hot workng in the metal for refining grain structure. A sheet 21 of solid metal leaves the rolls on the opposite side of the molten metal feed tip.

For convenience of illustration, the feed tip 14 is shown in a generally horizontal plane with the upper roll 11 directly above the lower roll 12. It will be apparent that the same arrangement is applicable to other orientations. Thus, there are certain advantages in a vertical continuous caster where the axes of the rolls are in a horizontal plane and molten metal is fed upwardly into the gap between the rolls. There are distinct advantages to an arrangement where the plane of the feed tip is tilted upwardly at about 15° from horizontal so that molten metal feeds upwardly into the gap between the rolls. The molten metal feed tip assembly provided in practice of this invention is suitable for use in any such orientation.

Figure 2:
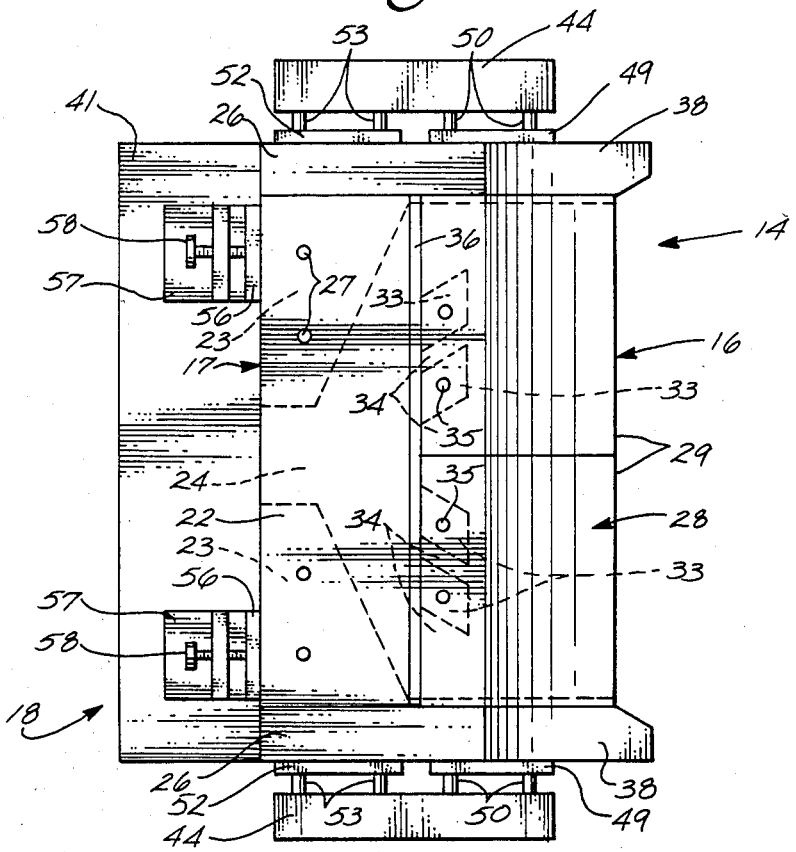
FIG. 2 is a top view of the molten metal feed tip and tip holder of FIG. 1.

With reference to FIGS. 1 and 2, the upstream unit 17 of the feed tip assembly 14 comprises a pair of generally rectangular spaced-apart upstream plates 22 having a generally uniform thickness. The upstream plates 22 may be formed from a single integral piece of material or may comprise two or more sections or segments. The spacing between the upstream plates 22 is maintained by a pair of spacers 23. The spacers 23 are separated to form a passage or channel 24 through which molten metal 13 can flow. The ends of the upstream unit 17 are closed by upstream end dams 26. A pair of bolt holes 27 extend through the upstream plates 22 and spacers 23 for mounting the upstream unit 17 in the tip holder 18.

The downstream unit 16 has generally the same width as the upstream unit 17 and comprises a pair of spaced-apart downstream plates 28. In the embodiment shown in FIG. 2, each downstream plate 28 comprises two generally identical segments 29 in edge-to-edge abutment along the width of the downstream plate 28. It is apparent that each plate may be formed by a single segment and that if multiple segments are used, the number and/or size of the segments 29 may vary and will generally depend on the desired size, particularly the width of the downstream unit 16. While not preferred, it is also apparent that segments of differing sizes, e.g., differing widths, can be used if desired. Presently preferred segments are about 15 centimeters wide.

The segments 29, and hence the downstream plates 28 comprise an upstream section 31 of generally uniform thickness and a downstream section 32 in which the thickness of the downstream plates 28 tapers gradually to a select lesser thickness at the downstream edge of the downstream unit. It is preferred that the outer surface the downstream section 32 have a radius generally the same as the radius of the rolls 11 and 12 so that when the downstream unit 16 is inserted between the rolls, the outer surface of the downstream plates will follow the contour of the rolls.

The spacing between the upstream sections 31 of the downstream plates 28 is generally uniform and about the same as the spacing between the upstream plates 22 of the upstream unit 17. This spacing is maintained by spacers 33 which are attached to the inner surface of the downstream plates 28, for example by glue. The spacers 33 are separated to form channels 34 through which the molten metal can pass. The spacers 33, and hence the channels 34 are oriented to distribute the molten metal throughout the downstream unit 16 of the tip assembly and to provide a generally uniform flow of molten metal into the nip of the rolls from the downstream unit. The downstream plates 28 and spacers 33 comprise bolt holes 35 for mounting the downstream unit 16 in the tip holder 18.

The downstream portions 32 of the downstream plates 28 converge toward each other. Accordingly, the spacing between the downstream plates 28 is less at their downstream edges than the upstream edges. This assures that metal velocity increases as it flows through the tip instead of decelerating. A substantially straight taper of the space through which molten metal flows between the upstream portion and the downstream edges is also desirable to minimize abrupt changes in the velocity of metal flowing through the continuous caster tip. Such an arrangement can minimize discontinuities in metal flow and avoid introduction of impurities in sheet formed by the continuous caster.

An elongated, generally rectangular brace 36 extends across the upstream edges of the downstream plates 28. The length of the brace 36 is generally equal to the width of the downstream plates 28. The width or height of the brace 36 is about equal to the distance between the outer surfaces of the downstream plates 28 at their upstream edges. The brace 36 is fixedly attached to the upstream edges of the downstream plates 28. Attachment may be by any suitable means, e.g., by glue. The brace 36 thus maintains the segments 29 of the downstream plates 28 in edge-to-edge abutment and, along with spacers 33, maintains the spacing between the downstream plates 28.

Figure 3:
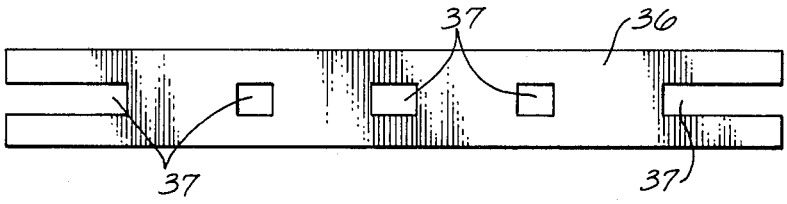
FIG. 3 is an end view of the brace of the downstream unit.

As shown in FIG. 3, the brace 36 comprises openings 37 at locations corresponding to the channels 34. The openings 37 thus form a continuation of the channels 34 and allow molten metal to flow into the downstream unit 16 from the upstream unit 17.

Figure 4:
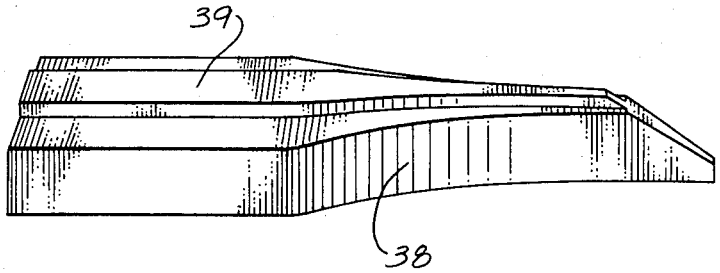
FIG. 4 is a perspective view of a preferred end dam.

The ends of the downstream plates 28 are enclosed by downstream end dams 38. As shown in FIG. 4, the end dams have a raised locating projection 39 which extends into the space between the downstream plates 28. The locating projection 39 facilitates assembly and orientation of the downstream end dams 38 onto the ends of the downstream plates 28 and helps to maintain proper spacing between the downstream plates 28. Like the brace 36 and spacers 33, the downstream end dams 38 are attached to the downstream plates 28 by any suitable means, preferably by glue.

With reference again to FIGS. 1 and 2, the tip assembly 14 is mounted in the tip holder 18 of the casting machine. The tip holder 18 comprises a base 41, upstream and downstream mounting plates 42 and 43, and a pair of end plates 44.

In mounting the tip assembly 14 into the tip holder 18, the downstream unit 16 is mounted first. The downstream unit 16 is secured in the holder 18 between the base 41 and the downstream mounting plate 43 by bolts 47 which extend through bolt holes 35 in the downstream unit 16. Lateral pressure is exerted on the downstream end dams 38 to prevent separation of the segments 29 of the downstream plates 28, and to prevent separation of the downstream end dams 38 from the downstream plates lateral pressure is applied by side push plates 49 which can be adjusted laterally by adjusting bolts 50.

The upstream unit 17 of the tip assembly 14 is mounted in the holder 18 between the base 41 and the upstream mounting plate 42. The upstream unit 17 of the tip assembly 14 is pressed against the the downstream unit 16 by means of rear push plates 56, which are adjustably mounted onto base 41 by bracket 57. Adjustment is made by adjusting bolt 58. The bolts 46 and side push plates 52 are then tightened to secure the upstream unit 17 of the tip assembly 14 to the holder 18. The upstream unit 17 is also secured in the tip holder 18 by bolts 46 which extend through bolt holes 27 in the upstream unit 17 and the upstream end dams 26 are pressed against the upstream plates 22 to form a leakproof seal by side push plates 52, which are adjustable by adjusting bolts 53.

To assure that there is no leakage between the upstream and downstream units 17 and 16, a gasket 51, preferably of ceramic fiber paper is positioned between the upstream edges of the downstream unit 16 and the downstream edges of the upstream unit 17.

The various pieces of the tip assembly 14, i.e., the upstream and downstream plates 22 and 28, spacers 23 and 33, end dams 26 and 28 and brace 36, can be made of any suitable material. Presently preferred materials include ceramic fiber compositions sold by the Carborundum Co. of Niagara Falls, N.Y. under their trademarks Fiberfrax and Kaowool.

It is apparent that the upstream unit 17 can be of any size and shape suitable for a particular casting machine and its tip holder. The upstream unit may be preassembled or, because it requires replacement less often than the downstream unit 16, may be assembled on the tip holder 18. If preassembled any suitable means of connecting the various pieces, of the upstream unit, i.e., upstream plates, spacers and end dams, may be used. Conventional glues and cements are presently preferred. Once mounted in the tip holder, tightening of the upstream mounting plate and side push plates will keep the upstream unit together and evaporation of the glue is irrelevant.

Likewise, the shape and size of the downstream unit may vary. As the downstream unit will generally be replaced more frequently than the upstream unit and generally as often as conventional tips are now replaced, it is preferred that the downstream unit be preassembled. Thus, the present invention offers the unique advantage of providing a tip assembly which minimizes both the amount of tip material and machine downtime required by a normal tip replacement.

As with the upstream unit, any suitable means for connecting or bonding the various pieces of the downstream unit together can be used. Conventional glues are presently preferred. It is preferred that the bonding means, e.g., glue, be sufficiently strong to allow the downstream sections of the downstream plates to be sanded before the downstream unit is assembled into the tip holder, again, to minimize machine downtime.

It is also apparent that, in embodiments of the invention wherein the plates of the downstream unit are each made of a single segment, there is no need for a brace. In such embodiments, the downstream unit is preassembled with the spacers being glued to the plates. Alternatively, the downstream unit can simply be cast as a single integral unit.

It is apparent that many other changes or alterations in the precise structures described above can be practiced without departing from the scope of the present invention. For example, the number, shape and/or size of the spacers in both the upstream and downstream units can vary, as desired. While preferred, end dams without locating projections may be used. The precise shape of the brace may vary and, in fact, embodiments having no brace across the upstream edges of the segments of the downstream plates may be practiced. In such an embodiment, other means, e.g., spacers which overlap abutting segments, may be used to maintain the segments in edge-to-edge abutment.

Accordingly, the foregoing description should not be read as pertaining only to the precise structures described, but rather should be read consistent with and as support for the following claims which are to have their fullest fair scope.

What is claimed is:

1. A molten metal feed tip assembly mountable in a tip holder of a continuous casting machine comprising:
- an upstream unit comprising:
  - a pair of upstream plates;
  - at least one spacer between the upstream plates for spacing the upstream plates apart and for forming at least one upstream channel between the upstream plates for the downstream flow of molten metal through the upstream unit; and
  - a pair of upstream end dams for enclosing the ends of the upstream plates;
- a preassembled downstream unit mountable in leakproof abutment with the upstream unit comprising:
  - a pair of downstream plates, each comprising two or more segments;
  - means for maintaining the segments of each downstream plate in edge-to-edge abutment;
  - at least one spacer between the downstream plates for spacing the downstream plates apart and for forming at least one downstream channel for the downstream flow of molten metal from the upstream unit through the downstream unit; and
  - a pair of downstream end dams for enclosing the ends of the downstream plates.

2. A molten metal feed tip assembly as claimed in claim 1 wherein the means for maintaining the segments of the downstream plates in edge-to-edge abutment comprises a brace which extends across and is fixedly attached to the upstream edges of the segments.

3. A molten metal feed tip assembly as claimed in claim 2 wherein the brace is fixedly attached to the upstream edges of the segments by glue.

4. A molten metal feed tip assembly as claimed in claim 1 wherein the downstream end dams comprise a locating projection which extends into a space between the downstream plates.

* * * * *